United States Patent [19]

Brantley

[11] Patent Number: 4,751,893

[45] Date of Patent: Jun. 21, 1988

[54] ANTI-GLARE SCREEN

[76] Inventor: William S. Brantley, Rte. 1, Box 66, Elm City, N.C. 27822

[21] Appl. No.: 28,345

[22] Filed: Mar. 20, 1987

[51] Int. Cl.[4] ..... E01F 13/00

[52] U.S. Cl. ..... 116/63 R; 256/13.1; 404/9

[58] Field of Search ..... 116/63 R, 63 P; 404/6, 404/9, 12, 71; 256/1, 13.1, 24; 138/121, 125, 155, 173

[56] References Cited

U.S. PATENT DOCUMENTS

| | | | |
|---|---|---|---|
| 2,728,356 | 12/1955 | Brinsmade et al. | 138/121 |
| 3,114,303 | 12/1963 | Oberbach | 404/6 |
| 4,338,041 | 7/1982 | Schmanski | 404/9 |

FOREIGN PATENT DOCUMENTS

| | | | |
|---|---|---|---|
| 1207418 | 12/1965 | Fed. Rep. of Germany | 256/13.1 |
| 1534527 | 2/1971 | Fed. Rep. of Germany | 256/13.1 |
| 1300536 | 6/1962 | France | 256/13.1 |
| 2540533 | 8/1984 | France | 256/13.1 |
| 2560243 | 8/1985 | France | 256/13.1 |
| 716904 | 10/1966 | Italy | 256/13.1 |

*Primary Examiner*—William A. Cuchlinski, Jr.
*Assistant Examiner*—W. Morris Worth
*Attorney, Agent, or Firm*—Rhodes, Coats & Bennett

[57] ABSTRACT

An anti-glare screen adapted to be mounted to concrete median barriers so as to block light from the headlights of oncoming vehicles on the opposite side of the glare screen. The anti-glare screen comprises a plurality of corrugated sections overlapped to form a continuous barrier yet flexible enough to conform to bends in a roadway.

3 Claims, 3 Drawing Sheets

ANTI-GLARE SCREEN

FIELD OF THE INVENTION

The present invention relates generally to highway safety devices and more particularly to light blocking devices such as fences, screens and the like positioned in the center of a divided highway to block light from an oncoming vechicle.

BACKGROUND OF THE INVENTION

Concrete median barrier walls at use today are well suited for dividing traffic lanes but are not high enough to shield motorists from the glare of lights from oncoming vehicles. Anti-glare screens have been developed which mount on top of such median barriers. Such prior art structures may be seen in U.S. Pat. Nos. 3,349,674; 3,583,297; and 4,088,415.

U.S. Pat. No. 3,349,674 discloses a headlight shielding device comprising a blade having a central tubular section with two opposite arcuate sections extending outwardly from either side thereof.

U.S. Pat. No. 3,583,297 teaches an anti-dazzling screen formed from a series of transversely flat arch-shaped members positioned in continuous row.

U.S. Pat. No. 4,088,415 discloses a glare screen blade having a width substantially greater than its thickness and provided with raised chevron like configurations on its wider surfaces to deflect light directed thereagainst.

The aforementioned patented devices do not provide a complete visual barrier and do not totally eliminate the problem of glare which may be caused in part by reflected light.

SUMMARY AND OBJECTS OF THE INVENTION

After much research and study into the foregoing problems the present invention was developed to provide an anti-glare screen which not only blocks the light from headlights of oncoming vehicles, but also reduces the amount of reflected light which contributes to glare problems.

The anti-glare screen of the present invention comprises a plurality of corrugated sections which are interlocked to form a continuous and uninterrupted screen or barrier. Each corrugated section is in the form of an elongated vertically standing U-shaped structure having alternating raised and indented segments. The corrugations provide ridgidity to the structure so as to be resistant to wind, while remaining flexible enough to conform to bends in the roadway.

From the foregoing, it is the primary object of the present to provide an inexpensive solution to blinding lights of oncoming traffic when roads and bridges are divided with barrier walls.

Another object of the present invention is to provide an anti-glare screen which simultaneously serves as a visual barrier to motorists against objects or activities along the roadside which may divert their attention from the roadway.

A further object of the present invention is to provide an anti-glare screen which may also serve as a restriction above bridge railings that are not tall enough for the security of walking pedestrians.

Another object of the present invention is to provide an anti-glare screen having a corrugated surface which serves to strengthen the barrier against the wind and to break up reflected light.

Another object of the present invention is to provide an anti-glare screen which will be continuous and uninterrupted, yet flexible enough to conform to bends in the roadway.

Another object of the present invention is to provide an anti-glare screen that will be relatively simple in construction and easily installed.

Yet another object of the present invention is to provide an anti-glare screen that requires only simple maintenance and has an extended useful life.

Other objects and advantages of the present invention will become apparent and obvious from a study of the following description and the accompanying drawings which are merely illustrative of such invention.

DETAILED DESCRIPTION OF THE INVENTION

Figure 1:
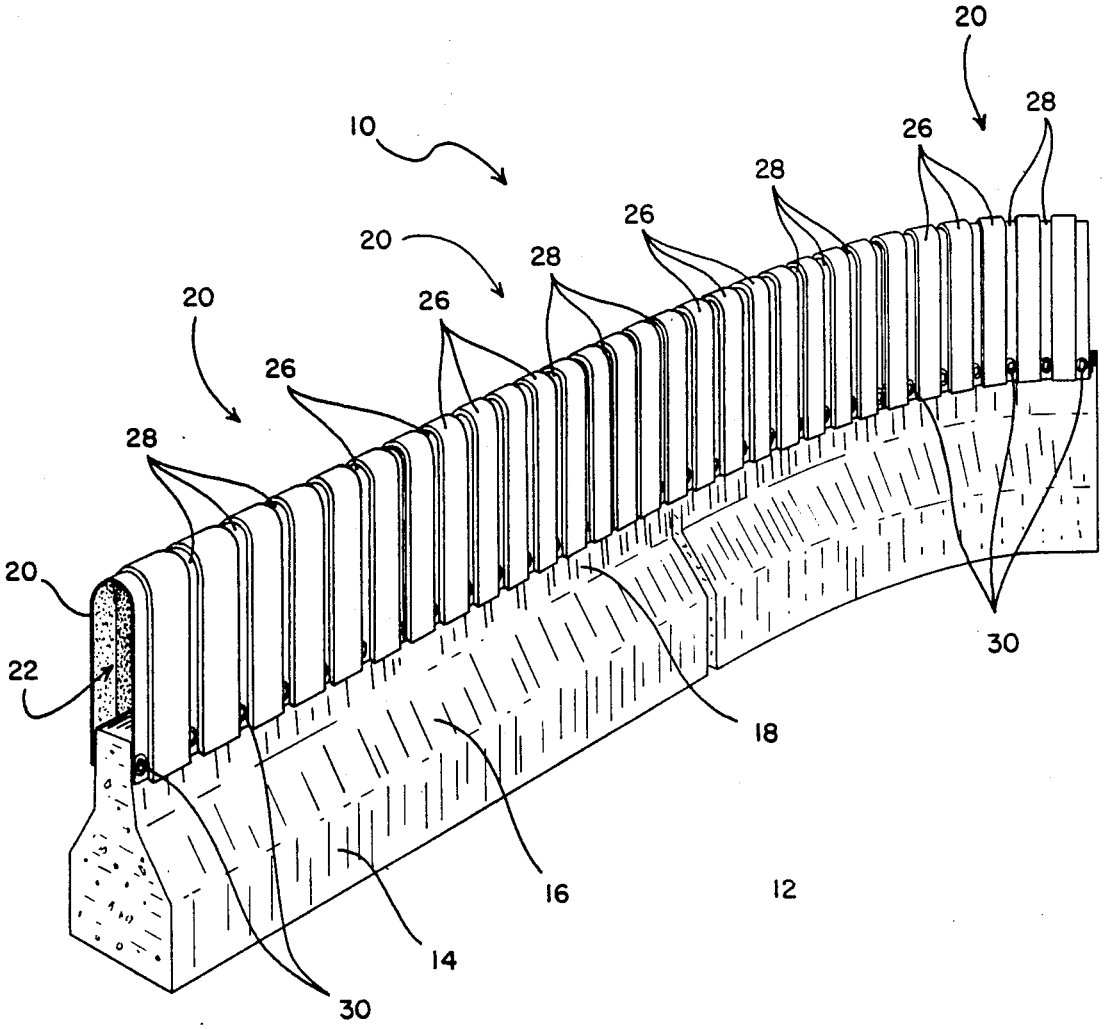
FIG. 1 is a perspective view of the anti-glare screen of the present invention.

Referring now to the drawings, the anti-glare screen of the present invention is shown therein and indicated generally by the numeral 10. Anti-glare screen 10 is adapted to be mounted on a concrete median barrier such as that indicated generally at 12. Concrete barrier 12 includes a relatively wide base portion 14, a tapered intermediate portion 16 and a narrower top portion 18. Concrete barriers 12 of the type herein described generally extend to a height of approximately 30 to 36 inches from the roadway—a height insufficient to block the light of oncoming vehicles.

The anti-glare screen 10 of the present invention serves to extend the barrier an additional 2 feet or more and thus eliminates the problem of blinding lights from oncoming vehicles. The anti-glare screen 10 is constructed from a plurality of screen sections 20 which may be joined to form a continuous and uninterrupted screen of any desired length.

Each screen section 20 has an inverted, generally U-shaped cross section. The lower edges 24 of each screen section define a continuous opening 22. When mounting a screen section 20 on a barrier wall 12, the top portion 18 of the barrier wall 12 is inserted into the cross sectional area of the screen section 20 between the lower edges thereof and secured as hereinafter described in detail.

Figure 2:
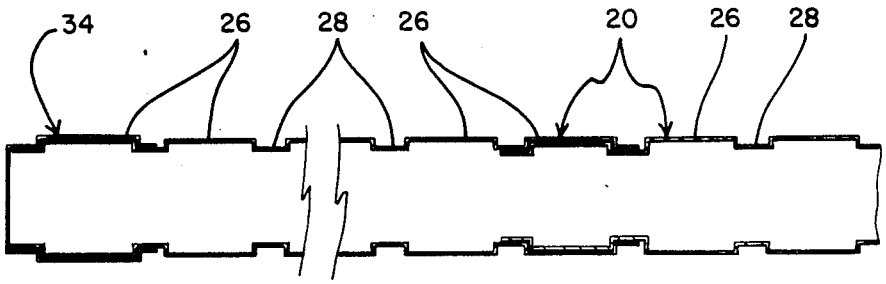
FIG. 2 is a top section thereof.
Figure 3:
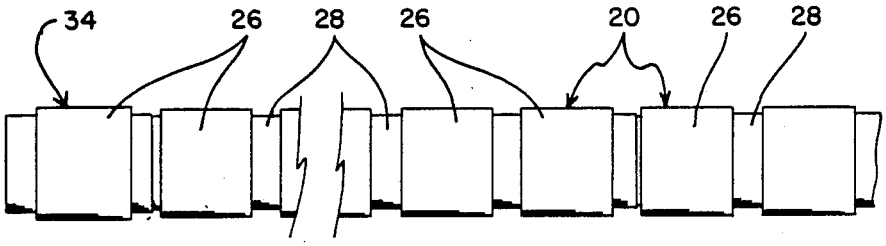
FIG. 3 is a top plan view thereof.
Figure 4:
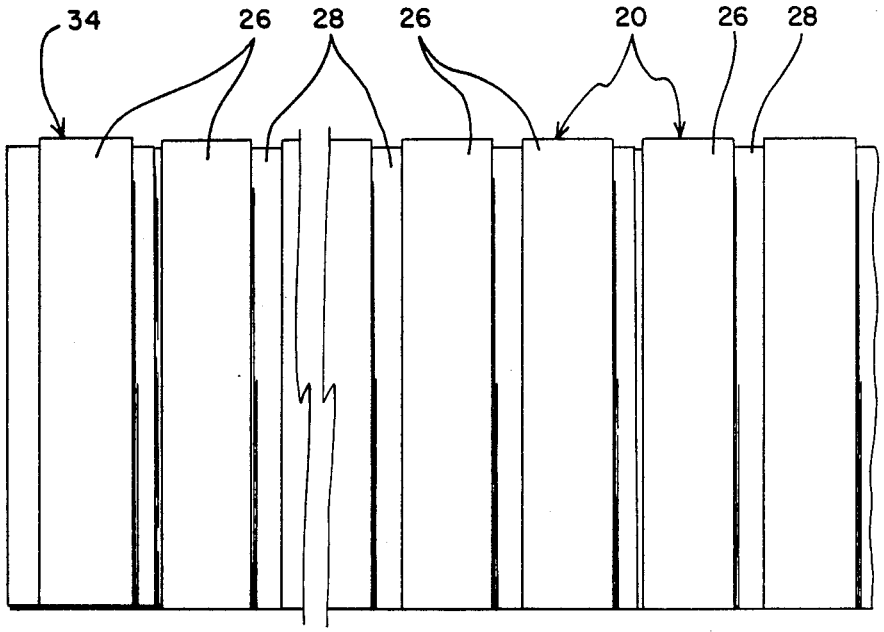
FIG. 4 is a side elevational view thereof.

The walls of each screen section 20 are corrugated; consisting of a plurality of longitudinally alternating raised segments 26 and indented segments 28 (FIG. 2). The raised segments 26 and indented segments 28 have a substantially vertical orientation as can be clearly seen in FIGS. 1 and 4. The corrugated walls of the screen sections 20 reinforce the antiglare screen 10 against wind and other lateral forces. Additionally, the corrugations serve to reduce the amount of light reflected from the anti-glare screen 10.

Figure 5:
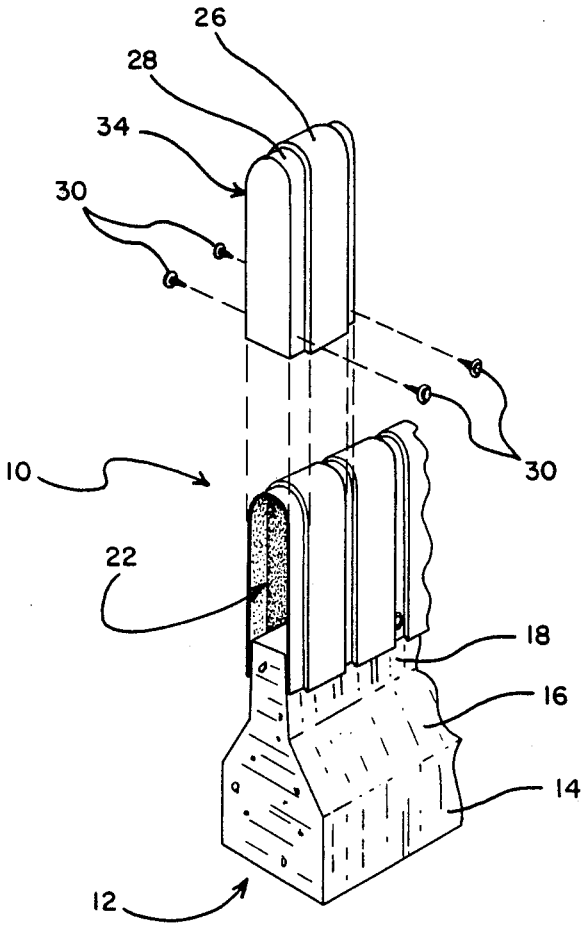
FIG. 5 is a detailed perspective view thereof.
Figure 6:
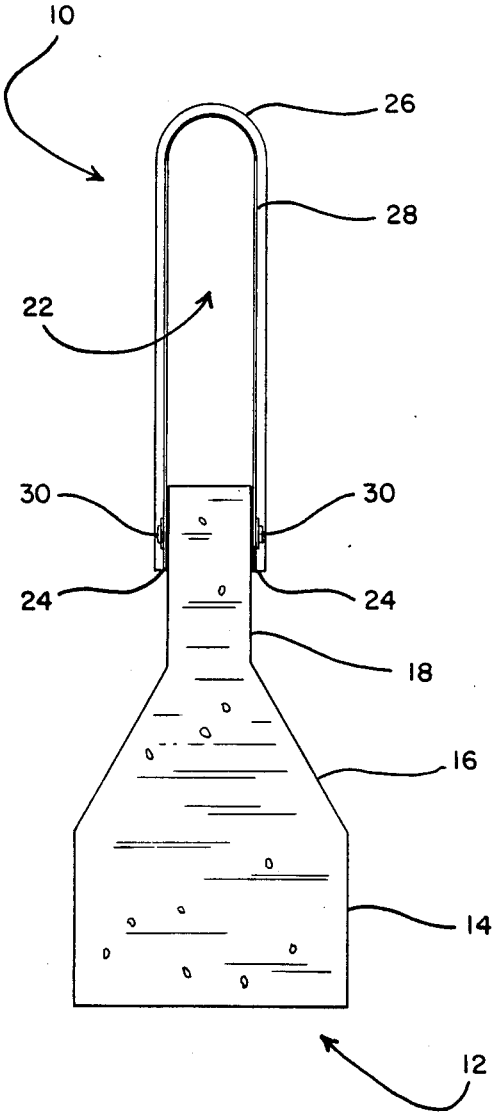
FIG. 6 is a transverse section thereof.

The individual screen sections 20 can be joined to form a continuous and uninterrupted screen of any desired length. This is accomplished by reducing the size of a raised segment 26 adjacent one end of the screen section 20 so as to fit snuggly within the raised segment 28 at the opposite end of the screen section 20 as indicated at 29. Two adjacent segments can therefore be slid edgewise into engagement within one another as shown in FIGS. 2 and 5. The two adjacent screen sections 20 should, of course, fit snuggly within one another so as to provide a secure connection and so as to prevent the entry of water. Any desired number of screen sections 20 can be connected in this manner to form a continuous and uninterrupted screen of any desired length.

Similarly, end caps 34 are provided having a single raised segment 26 that is slightly larger than the raised segment 26 of one of the screen sections 20. This allows the end cap 34 to be slid edgewise over the last raised segment 26 of the last screen section 20 to close the same as can best be seen in FIGS. 2 and 5.

The anti-glare screen screen 10 can be fixedly secured to pre-existing concrete barrier walls 12 by any suitable means such as anchor bolts 30. The anti-glare screen fits over top portion 18 of barrier wall 12 with the edges 24 of the anti-glare screen 10 being disposed on opposite sides thereof. A plurality of apertures 32 are formed in the indented portion 28 of anti-glare screen 10 and are disposed adjacent the edge 24 thereof. Once the anti-glare screen 10 is positioned on the barrier wall 12 the anchor bolts 30 may be extended through apertures 32 and into barrier walls.

It is contemplated that the screen sections described hereinabove are to be constructed from a suitable plastic using and injection molding process. The material used should be flexible enough to allow the screen sections 20 to be bent so as to conform to curves in the roadway along which the anti-glare screen is used. Since plastics of this type an injection molding processes are well known to those skilled in the art, further discussion of the same is not deemed necessary.

From the foregoing it is apparent that the present invention provides a continuous and uninterrupted anti-glare screen for blocking light from the headlights of oncoming vehicles, as well as reducing the amount of light reflected from the screen. The anti-glare screen of the present invention has the additional benefit of being flexible enough to conform to bends in the roadway while strong enough to resist winds and other lateral forces.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. An anti-glare screen for use in connection with a roadway median barier of the type including a relatively wide base portion and a narrower top portion, the anti-glare screen comprising:

(a) a plurality of generally U-shaped, flexible screen sections mounted on the top portion of the median barrier;

(b) each said screen section comprising:

(1) a pair of parallel spaced-apart walls extending upwardly from the top portion of the median barrier to a height sufficient to block light from oncoming vehicles;

(2) a connecting portion disposed substantially above the top portion of the median barrier for joining uppermost portions of the spaced-apart walls to form an inverted, U-shaped section;

(3) a series of vertically oriented corrugations for reinforcing the screen sections against lateral forces, each said corrugation beginning at the lowermost portion of one spaced-apart wall and extending over the connecting portion and terminating at the lowermost portion of the other spaced-apart wall; and (c) means for joining the screen section in end-to-end relationship to form a continuous, uninterrupted screen for blocking light of oncomining vehicles.

2. The anti-glare screen of claim 1 wherein said joining means includes a first corrugation adjacent one end of said screen section and a second corrugation formed adjacent the opposite end of said screen section capable of being slideably received in a first corrugation of a similarly formed screen section.

3. The anti-glare screen of claim 2 wherein the corrugations of the screen sections have a substantially rectilinear configuration so that the variously disposed surfaces of the corrugation tend to reflect light in different directions thereby reducing glare.

* * * * *